US009518527B2

(12) United States Patent
Kylström

(10) Patent No.: US 9,518,527 B2
(45) Date of Patent: Dec. 13, 2016

(54) METHOD AND DEVICE FOR FUNCTIONAL CONTROL OF A HIGH PRESSURE FUEL PUMP

(71) Applicant: SCANIA CV AB, Södertälje (SE)

(72) Inventor: Kim Kylström, Tullinge (SE)

(73) Assignee: SCANIA CV AB (SE)

( * ) Notice: Subject to any disclaimer, the term of this patent is extended or adjusted under 35 U.S.C. 154(b) by 0 days.

(21) Appl. No.: 14/892,074

(22) PCT Filed: May 22, 2014

(86) PCT No.: PCT/SE2014/050627
§ 371 (c)(1),
(2) Date: Nov. 18, 2015

(87) PCT Pub. No.: WO2014/189458
PCT Pub. Date: Nov. 27, 2014

(65) Prior Publication Data

US 2016/0108846 A1 Apr. 21, 2016

(30) Foreign Application Priority Data

May 23, 2013 (SE) ..... 1350628

(51) Int. Cl.
*F02M 1/00* (2006.01)
*F02D 41/38* (2006.01)
(Continued)

(52) U.S. Cl.
CPC ..... *F02D 41/3854* (2013.01); *F02D 41/221* (2013.01); *F02D 41/26* (2013.01);
(Continued)

(58) Field of Classification Search
CPC ..... F02D 41/3809; F02M 63/0275; F02M 69/465; F02M 37/0029
(Continued)

(56) References Cited

U.S. PATENT DOCUMENTS 5,941,214 A * 8/1999 Hoffmann ..... F02D 41/3845 123/447
7,431,018 B2 10/2008 Tsujimoto
(Continued)

FOREIGN PATENT DOCUMENTS

DE 10 2011 102282 A1 11/2012
WO WO 2012/147186 A1 11/2012

OTHER PUBLICATIONS

International Search Report dated Sep. 25, 2014 issued in corresponding International patent application No. PCT/SE2014/050627.

*Primary Examiner* — John Kwon
(74) *Attorney, Agent, or Firm* — Ostrolenk Faber LLP

(57) ABSTRACT

A method for function control of a high pressure pump (5) in a system for fuel injection in a combustion engine: The method is carried out during stationary operating conditions in the combustion engine, with a constantly requested reference value for the fuel pressure in an accumulator tank (6). A feeding pump (2) in a low pressure part (3) of the system is controlled so that the fuel pressure in the low pressure part at the inlet to the high pressure pump falls, and at the same time this fuel pressure is measured, as is the fuel pressure in the accumulator tank. The development of the measured fuel pressure in the accumulator tank is compared to the reference value during the pressure reduction in the low pressure part, for the generation of information about the high pressure pump's functionality.

14 Claims, 5 Drawing Sheets

(51) Int. Cl.

| | |
|---|---|
| ***F02D 41/22*** | (2006.01) |
| ***F02M 59/10*** | (2006.01) |
| ***F02D 41/26*** | (2006.01) |
| ***F02M 59/02*** | (2006.01) |
| *F02M 59/36* | (2006.01) |
| *F02D 33/00* | (2006.01) |

(52) U.S. Cl.
CPC ..... *F02D 41/3845* (2013.01); *F02M 59/025* (2013.01); *F02M 59/102* (2013.01); *F02D 33/006* (2013.01); *F02D 2041/224* (2013.01); *F02M 59/366* (2013.01)

(58) Field of Classification Search
USPC ..... 123/456, 457, 463, 495
See application file for complete search history.

(56) References Cited

U.S. PATENT DOCUMENTS

| | | | | |
|---|---|---|---|---|
| 2007/0295310 | A1* | 12/2007 | Achleitner | F02D 41/3082 123/495 |
| 2008/0264155 | A1* | 10/2008 | Achleitner | F02D 41/221 73/114.42 |
| 2012/0037119 | A1* | 2/2012 | Adler | F02D 41/08 123/339.15 |
| 2013/0013174 | A1 | 1/2013 | Nistler et al. | |
| 2014/0373812 | A1* | 12/2014 | Hashim | F02D 41/3863 123/445 |
| 2015/0275816 | A1* | 10/2015 | Pursifull | F02D 41/3094 123/456 |
| 2016/0108879 | A1* | 4/2016 | Kylstrom | F02M 63/027 123/447 |

* cited by examiner

METHOD AND DEVICE FOR FUNCTIONAL CONTROL OF A HIGH PRESSURE FUEL PUMP

CROSS-REFERENCE TO RELATED APPLICATIONS

The present application is a 35 U.S.C. §§371 national phase conversion of PCT/SE2014/050627, filed May 22, 2014, which claims priority of Swedish Patent Application No. 1350628-2, filed May 23, 2013, the contents of which are incorporated by reference herein. The PCT International Application was published in the English language.

FIELD OF THE INVENTION

The present invention pertains to a method for function control of a high pressure pump in a system for fuel injection in a combustion engine. The system comprises an independent feeding pump, controllable by the combustion engine, for the supply of fuel in a low pressure part of the system to the high pressure pump. The latter comprises at least one pump element connected between the low pressure part and an accumulator tank for fuel injection to the combustion engine. The pump element has a cylinder with a pump chamber with a movable piston inside the chamber for purposes of pumping. In the connecting opening in this cylinder, there is an inlet valve to the low pressure part. The inlet valve is controllable for controlling the flow of fuel into the pump chamber. The invention also pertains to a device that performs the method.

The invention is not limited to any specific type of combustion engine or fuel, and diesel and ethanol may be mentioned as a couple of non-exhaustive examples of fuel. Also, the invention pertains to function control of a high pressure pump for supply of fuel to combustion engines that are designed for all types of use, such as in industrial applications, crushing machines and in various types of motor vehicles. The invention is particularly applicable to wheeled motor vehicles, especially commercial vehicles, such as trucks and buses, and will for this reason sometimes be discussed in this application with the objective of elucidating, but not limiting, the invention.

With respect to the low pressure part in a system for fuel injection in a combustion engine, the invention is applicable to systems in which the feeding pump is controllable independently of the combustion engine. This is advantageously achieved since the pump is driven by an electric engine, which may be controlled totally independently of the combustion engine's function. In other respects, the low pressure part of the system may have any appearance.

BACKGROUND TECHNOLOGY

In order to ensure a secure and efficient operation of a system, it is desirable to be able to discover impaired performance ability in the high pressure pump early, in order to be able to take suitable measures for the pump to function optimally again, or in order to replace the pump. Herein, limited performance ability of the high pressure pump may be due to the occurrence of a leak in one or several of the pump elements between the inlet valve and the pump chamber's connecting opening to the low pressure part, e.g. because of a somewhat damaged valve, or leakage between the piston and pump chamber wall because of wear particles getting caught in the fuel and damaging the wall.

U.S. Pat. No. 7,431,018 describes a method for detecting faults in a high pressure pump by measuring the fuel pressure in the area of the accumulator tank and comparing this with reference values. This is done with the help of a pressure regulator and pressure fault sensor, and the method described therein consists of a relatively blunt instrument for function control of a high pressure pump, and is more focused on discovering larger faults in the function of the same.

SUMMARY OF THE INVENTION

The objective of the present invention is to provide a method and a device of the type defined above, which are improved in at least some respect in relation to prior art methods and devices of this type, with respect to achieving a reliable function control of a said high pressure pump.

The invention is thus based on the insight that in stationary operating conditions of the combustion engine, with a constantly requested reference value of the fuel pressure in the accumulator tank, the feeding pump may be controlled so that the fuel pressure in the low pressure part at the inlet to the high pressure pump is reduced. At the same time, the pressure in the accumulator tank is measured and compared to the requested reference value of the fuel pressure in the accumulator tank, in order to use the outcome of this comparison as an indication of the high pressure pump's functionality. It has been found that with such a method, the occurrence of both the above mentioned types of leakage, i.e. at the inlet valve and between the piston and the pump chamber wall, in the high pressure pump may be discovered.

Thus, the function control only requires stationary operating conditions in the combustion engine for a brief period of time, in the range of one second, in order to be carried out. When the combustion engine is located in a wheeled motor vehicle, the method may for example be carried out with desired intervals, when the vehicle is driven on a substantially horizontal base at a substantially constant speed.

According to one embodiment of the invention, the reduction of the fuel pressure at said position in the low pressure part is carried out toward a predetermined minimum pressure, at which the high pressure pump at normal functioning is incapable of delivering a fuel pressure in the accumulator tank which achieves the requested reference value, and the fuel pressure at the position in the low pressure part, at which the fuel pressure in the accumulator tank falls below the reference value, is registered as a limit pressure. By deciding the value of the limit pressure and its size in relation to the size of said minimum pressure, a measure of the high pressure pump's functionality may be obtained.

According to one further development of this embodiment, the pressure reduction in step b) is made down to a pressure which is higher than or equal to the minimum pressure, and the fuel pressure in the low pressure part at which the comparison in step d) gives a measurable difference, is registered as the limit pressure and used to determine the pump's functionality. If, by carrying out this method, a limit pressure which is higher than the minimum pressure is confirmed, then the conclusion may be drawn that the high pressure pump functions inadequately in its compression phase, because of the occurrence of a leakage between the piston and the pump chamber wall in one or several pump elements.

According to another embodiment of the invention, the pressure reduction is interrupted in the position, when the fuel pressure in the accumulator tank falls below the requested reference value by a predetermined difference value. This difference value may for example be 25-100 bar, 30-70 bar or around 50 bar, and when this occurs, the then prevailing pressure at the position may be determined as the limit pressure.

According to another embodiment of the invention, in step b) the feeding pump is controlled, so that the fuel pressure at the position falls until it is below a minimum pressure by at least 5%, 5-20% or 5-10% when the high pressure pump is unable, during normal functioning, to deliver a fuel pressure in the accumulator tank in accordance with the requested reference value. By reducing the pressure in the position in the low pressure part down to this level, the occurrence of so-called self-pumping due to the occurrence of a leakage in one or several pump elements between the inlet valve and the pump chamber's connecting opening to the low pressure part may be discovered. Where such a noticeable leakage occurs, the fuel pressure in the accumulator tank will not fall below the reference value, even though the pressure is at or below the minimum pressure at the position.

Accordingly, by reducing the pressure in the position of the low pressure part down toward the minimum pressure, the leakage between the piston and the pump chamber wall may be detected, but the limit value is not reached until the minimum pressure has been reached, or if it has not been reached, the pressure may be reduced a little to determine whether the high pressure pump has optimal functionality (the pressure in the accumulator tank should then fall) or whether one of the inlet valves is damaged (the pressure in the accumulator tank in that case does not fall).

According to another embodiment of the invention, the method for a high pressure pump is carried out with several of the pump elements connected in parallel between the low pressure part of the system and the accumulator tank, and in the stationary operating mode of the combustion engine, at which a single pump element is capable of delivering a fuel pressure in the accumulator tank according to the requested reference value alone, and steps a)-d) are carried out during the control of the high pressure pump's elements, so that the single pump element delivers the fuel pressure requested in the accumulator tank in order to determine the functionality of such pump element. By carrying out the method according to the invention in a stationary operating mode, which only requires the use of one pump element, a reliable functionality control of such specific pump element may be carried out. It is pointed out that the minimum pressure will thus be higher than in the event the functionality control is carried out in an operating mode with several pump elements operating simultaneously.

According to a further development of this embodiment, the steps a)-d) are carried out at intervals for all the pump elements during the control of the high pressure pump's pump elements, so that a single one of the high pressure pump's pump elements delivers a fuel pressure in the accumulator tank alone, according to the requested reference value for the determination of the functionality of all the pump elements. This embodiment thus facilitates the identification of a failing pump element, or a pump element with poorer functionality than normal.

According to another embodiment of the invention, the method comprises storage of data produced during the performance of the method steps, in order to provide the possibility of later assessment of the functionality of the high pressure pump or the high pressure pump and its pump elements. Thus, during maintenance of the high pressure pump, the parts of the latter which so require it, may be appropriately addressed.

The invention also provides a device according to the invention equipped with the features disclosed herein.

Other advantageous features and advantages with the invention are set out in the description below.

BRIEF DESCRIPTION OF THE DRAWINGS

Below are descriptions of example embodiments of the invention with reference to the enclosed drawings, in which.

DETAILED DESCRIPTION OF EMBODIMENTS ACCORDING TO THE INVENTION

Figure 1:
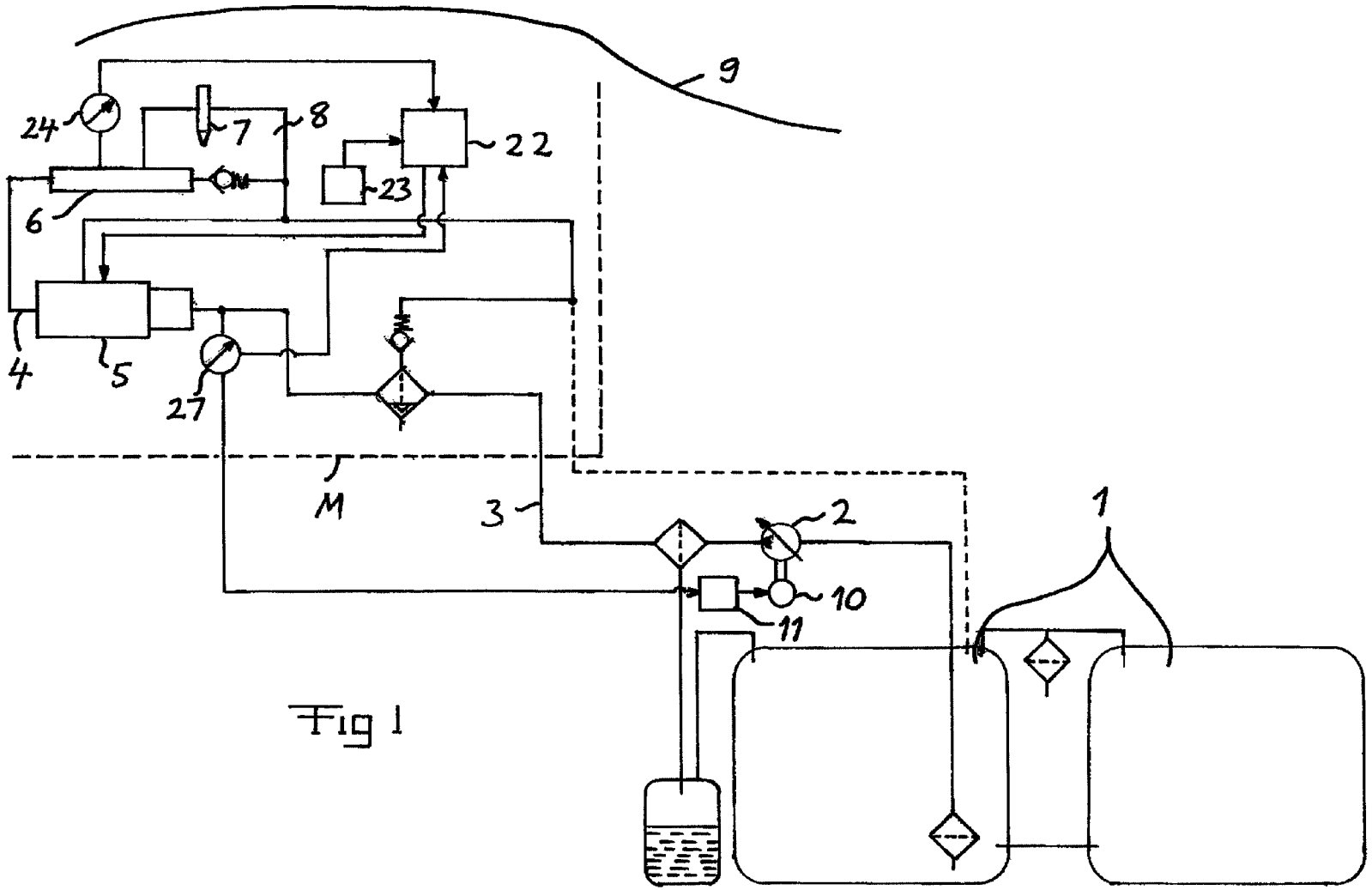
FIG. 1 is a schematic view illustrating the structure of a system for fuel supply to a combustion engine, comprising a device according an embodiment of the invention for the performance of a method according to the invention.

FIG. 1 shows a system for fuel injection in a combustion engine equipped with a device according to the invention, and on which methods according to the invention described below are applicable. The general structure of the system is prior art and comprises a fuel tank 1, which is here divided into two containers, from which fuel, via a feeding pump 2 in a low pressure part 3 with a pressure of for example 2-6 bar, is fed to a high pressure part 4 of the system, which starts with a high pressure pump 5, which pumps fuel at a high pressure, for example in the range of 500-2 500 bar, pumps fuel to an accumulator tank 6 with nozzles 7 for injection of fuel into the cylinders of the combustion engine 8, which is here arranged in a motor vehicle identified with the digit 9. The components which are drawn inside the frame M are here arranged on the combustion engine.

The feeding pump 2 is operated by an electric engine 10, which is controlled by a control device 11 and is thus controllable independently of the combustion engine.

Figure 2:
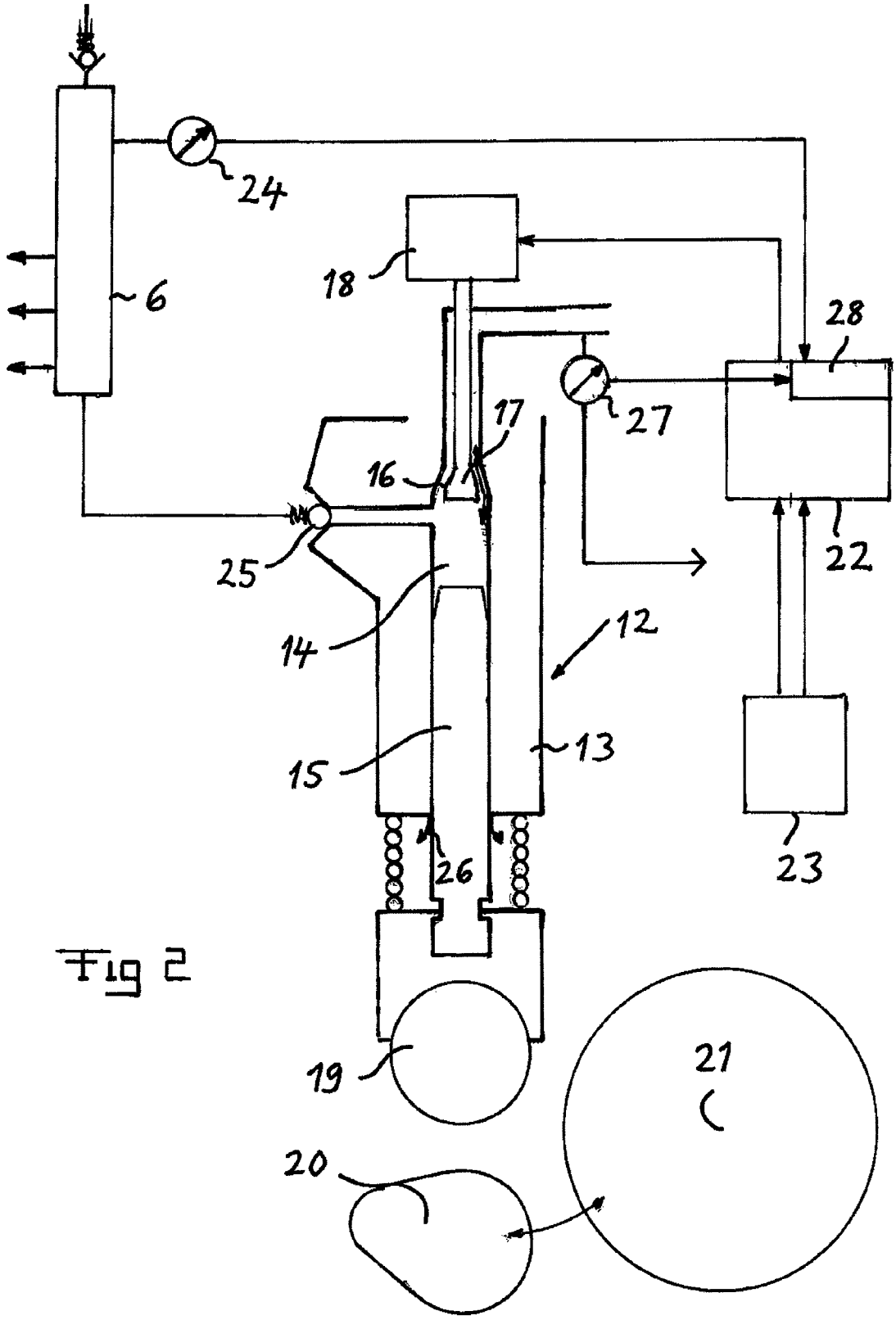
FIG. 2 is a simplified view, illustrating the structure and function of a pump element in a high pressure pump in a system according to FIG. 1, FIG. 3 and FIG. 4 are diagrams showing the pressure in the accumulator tank, and in the position in the low pressure part over time, at the performance of the method according to the invention according to two different embodiments.

Reference is now made to FIG. 2, with the help of which the structure and function of the high pressure pump 5 will be described in further detail. The high pressure pump comprises one or several pump elements, usually 2-3 pump elements, but the number is arbitrary and may be for example 8, and the pump elements are connected in parallel between the low pressure part 3 of the system and the accumulator tank 6 for fuel injection to the combustion engine. FIG. 2 shows only one of these pump elements 12, but they all have the same design and are controlled in the same manner, and in the event there are several such elements, they each have a cylinder 13 with a pump chamber 14, with a moveable piston 15 for pumping therein, and an inlet valve 17 in the cylinder's connecting opening 16 to the low pressure part, which valve is controllable via an actuator 18 in order to control the flow of fuel into and/or out of the pump chamber 14. Specifically, the pumping of fuel is effected via a pump element 12, through a lifter 19 connected with the piston 15 being impacted by a camshaft 20, which is mechanically connected to the combustion engine's crankshaft 21, so that the piston 15 will move forwards and backwards in the pump chamber 14 in accordance with the rotation of the engine crankshaft 21. The actuator 18 of the inlet valve 17 is controlled through control signals from a motor control device 22, which in its turn obtains information regarding the engine crankshaft's or the camshaft's instantaneous position, and thus the position of the piston 15, via the engine position sensors 23. The engine control device 22 also obtains information from an element 24 designed to measure the fuel pressure in the accumulator tank 6.

Generally this means that when the piston 15 moves in FIG. 2, seen in the downwards direction, and the pump chamber volume increases, the actuator 18 controls the inlet valve 17 so that it moves in the same direction, so that fuel may pass through the valve 17 in the connecting opening 16 and be sucked into the pump chamber 14. When the piston 15 then is in the region of its lowest position with maximum pump chamber volume, the actuator 18 controls the inlet valve 17, so that it moves upwards to abut against the walls defined in the connecting opening 16 and fit tightly against these, so that on subsequent piston upstrokes in the pump chamber existing fuel is compressed and pressed out past a check valve 25 toward the accumulator tank 6, in order to be injected into the cylinders of the combustion engine via this tank. Thus, if there are several pump elements, these may each have a conduit to the accumulator tank or, as indicated in FIG. 1, a joint conduit from the high pressure pump to the accumulator tank.

The function of a pump element may be degraded mainly through two types of leakage. One is due to fuel leaking past the piston 15, as indicated with the arrows 26, since the piston does not seal tightly against the surrounding pump chamber walls. This may be due to wear particles having entered the fuel and damaged the walls. The other type of leakage is a leakage past the inlet valve 17, from the pump chamber to the low pressure part 3, when the piston 15 is in the fuel compression phase and the inlet valve must fully close the connecting opening 16. This may be due to the valve being damaged, for example due to wear and tear.

There follows a description of characterising features of the present invention. For functionality control of the high pressure pump 5, a device according to the invention comprises elements 27 configured and operable to measure the fuel pressure in a position in the low pressure part at the inlet to the high pressure pump. This pressure measurement element 27 is configured to send information about the measured fuel pressure to the control device 11 to control the feeding pump 2, and to a device 28 arranged in the engine control device configured and operable to compare the pressure measured by the element 24 in the accumulator tank with a reference value for this, and, during the performance of the method according to the invention, to carry out this comparison in connection with a pressure reduction measured at one of the elements 27.

A method according to a first embodiment of the invention is designed to be carried out as described below with reference to the diagram in FIG. 3, which shows development of the fuel pressure P over time t. Thus, the uppermost straight line $P_B$ represents a requested reference value for the fuel pressure in the accumulator tank during a given stationary operating mode of the combustion engine, and this may e.g. be 2 000 bar. The dashed line $P_{min}$ shows the fuel pressure in the position in the low pressure part, and at which the high pressure pump in normal functioning is incapable of delivering a fuel pressure in the accumulator tank which reaches the requested reference value, and this pressure may for example be 3 bar. $P_{in}$ shows the pressure measured by the element 27 at the inlet to the high pressure pump, which during normal operation in the stationary operating mode of the combustion engine could be 5 bar. The method according to the invention is started at the time $t_0$, by the feeding pump being controlled to reduce the fuel pressure $P_{in}$ at the inlet to the high pressure pump. During this pressure reduction the pressure $P_s$ in the accumulator tank is measured and compared with the requested reference value $P_B$. The pressure reduction continues until a predetermined difference value Δ is achieved between $P_B$ and $P_s$, which may e.g. be 50 bar. This occurs at the time $t_1$, and the pressure $P_{in}$ at this time is registered as a limit pressure $P_G$. If this limit pressure is substantially consistent with $P_{min}$, then this indicates a good functionality of the high pressure pump. In the case displayed, however, the limit pressure is substantially higher than minimum pressure, namely around 3.5 bar, which indicates a reduced functionality of the high pressure pump and that a leak between the piston and the pump chamber wall in one or several pump elements probably exists. The time lapsed between $t_0$ and $t_1$, i.e. the time which is required to carry out the method according to the invention, may for example be around 500 ms.

Figure 3:
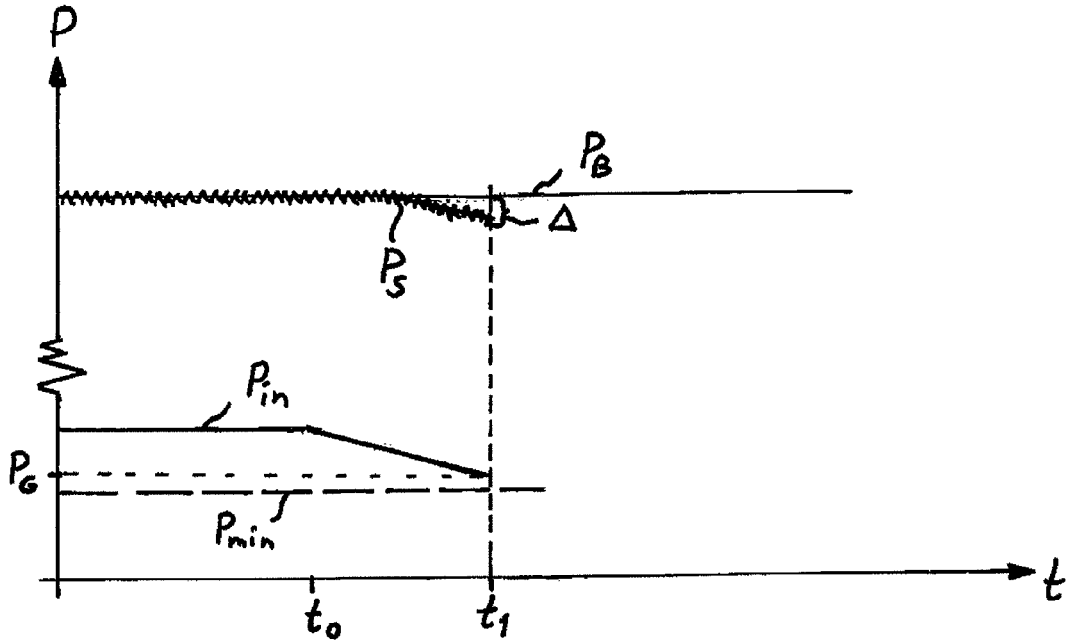
Figure 4:
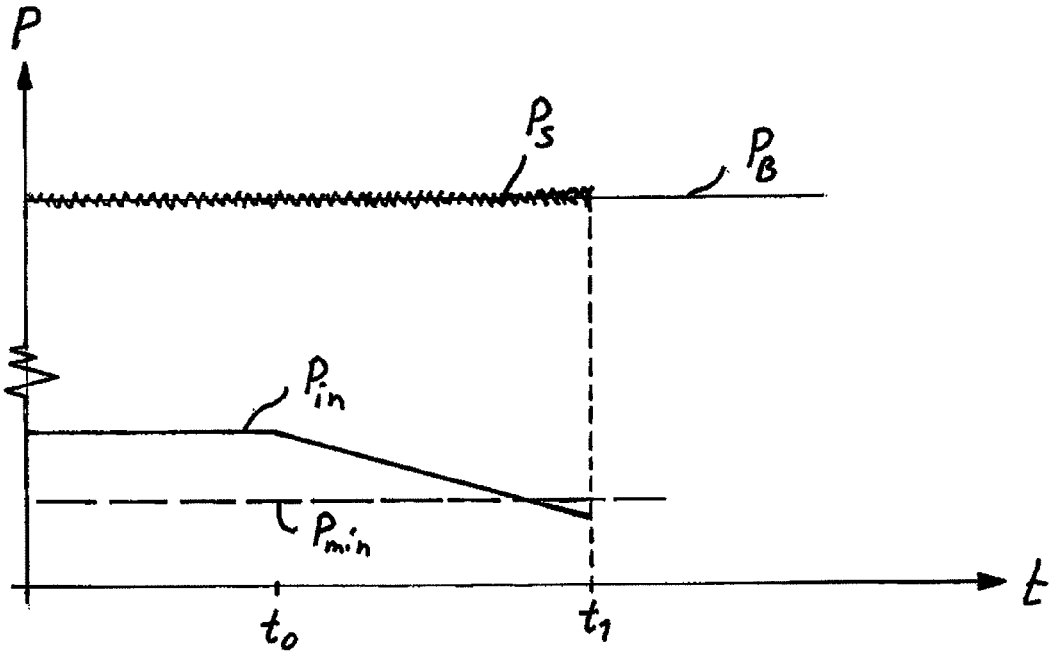

FIG. 4 shows the same type of diagram as FIG. 3 for the performance of the method according to the invention, according to another embodiment of the invention. In this case, the pressure $P_s$ in the accumulator tank does not fall below the requested reference value $P_B$ before $P_{in}$ reaches $P_{min}$, and the feeding pump is therefore controlled to reduce the pressure in the inlet to the high pressure pump further by around 10%, and yet the pressure still does not fall in the accumulator tank, but rather increases somewhat. This indicates so-called self-pumping through inadequate sealing, due to damage of one or several inlet valves in the high pressure pump.

Figure 5:
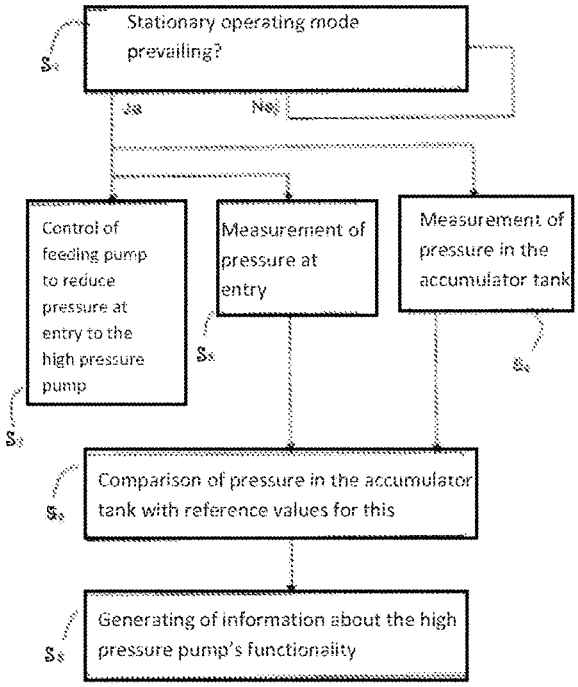
FIG. 5 is a flow chart showing a method according to one embodiment of the invention.

FIG. 5 shows a flow chart which illustrates a method according to one embodiment of the invention, for functionality control of a high pressure pump in a system for fuel injection in a combustion engine. A first step $S_1$ is to determine whether a stationary operating mode prevails in the combustion engine. If it prevails, then in a second step $S_2$, the fuel system's feeding pump 2 is controlled to reduce the pressure at the inlet to the high pressure pump 4, and this step is carried out in parallel with step $S_3$ of measuring the pressure at the inlet, and measuring the pressure $P_s$ in the accumulator tank 6 at a step $S_4$. In step $S_5$ the pressure measured in the accumulator tank is compared with a reference value $P_B$ for this, in order to be used in a step $S_6$ for generating information about the high pressure pump's functionality.

A computer program code for the implementation of a method according to the invention is suitably included in a computer program, loadable into the non-volatile internal memory of a computer, such as the internal memory of an electronic control device of a combustion engine. Such a computer program is suitably provided via a computer program product, comprising a non-volatile data storage medium readable by an electronic control device, which data storage medium has the computer program stored thereon. The data storage medium is e.g. an optical data storage medium in the form of a CD-ROM, a DVD, etc., a magnetic data storage medium in the form of a hard disk drive, a diskette, a cassette, etc., or a Flash memory or a ROM, PROM, EPROM or EEPROM type memory.

Figure 6:
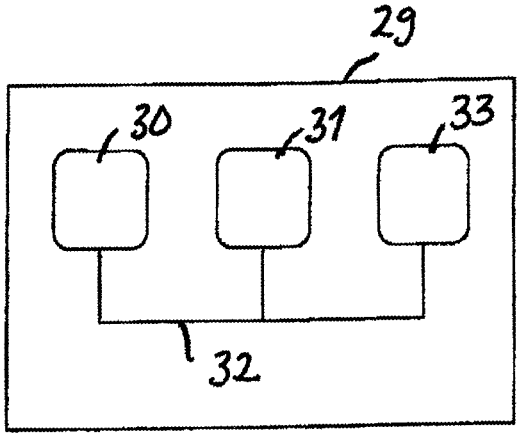
FIG. 6 is a diagram of an electronic control device for the implementation of a method according to the invention.

FIG. 6 illustrates schematically an electronic control device 29 comprising execution means 30, such as a central processor unit (CPU), for the execution of a computer software. The execution means 30 communicates with a memory 31, e.g. a RAM memory, via a data bus 32. The control device 29 also comprises a data storage medium 33, e.g. in the form of a Flash memory or a ROM, PROM, EPROM or EEPROM type memory. The execution means 30 communicates with the data storage means 33 via the data bus 32. A computer program, comprising computer program code for the implementation of a method according to the invention, for example in accordance with the embodiment illustrated in FIG. 4, is stored on the data storage medium 33.

The invention is obviously not limited in any way to the embodiments described above, but numerous possible modifications thereof should be obvious to a person skilled in the area, without such person departing from the spirit of the invention as defined by the appended claims.

The appearance of the high pressure pump's pump element could be different than as illustrated schematically in FIG. 2.

Is respect of the fuel, it would be fully possible to carry out the method on a combustion engine which is operated with a fuel which is gaseous at the pressure prevailing in the low pressure part, but which becomes liquid in the high pressure part, such as for example DME (dimethyl).

The methods could very well be carried out in the form of workshops tests. This also applies where the combustion engine is arranged in a motor vehicle.

The invention claimed is:

1. A method for functionality control of a high pressure pump in a system for fuel injection in a combustion engine, wherein the system comprises:

a feeding pump controllable independently of the combustion engine, for supplying fuel in a low pressure part of the system to the high pressure pump, the high pressure pump comprises at least one pump element connected between the low pressure part and an accumulator tank for fuel injection to the combustion engine, the at least one pump element has one cylinder defining a pump chamber and a moveable piston in the pump chamber for pumping in the pump chamber;

the cylinder having a connecting opening to the low pressure part, and an inlet valve arranged in the cylinder's connecting opening is controllable to control a flow of fuel into the pump chamber;

the method comprising:

during a stationary operating mode of the combustion engine with a constant requested reference value ($P_B$) for fuel pressure in the accumulator tank, the method comprises the steps:

a) measuring a first fuel pressure ($P_{in}$) in one position in the low pressure part at an inlet to the high pressure pump;

b) controlling the feeding pump, so that the first fuel pressure ($P_{in}$) in the one position in the low pressure part reduces and simultaneously measuring this first fuel pressure ($P_{in}$);

c) measuring a second fuel pressure in the accumulator tank ($P_s$) during the pressure reduction in the low pressure part in step b);

d) comparing development of the second fuel pressure ($P_s$) measured in step c) with the requested reference value ($P_B$) during the pressure reduction in the low pressure part in step b); and e) generating information about the high pressure pump's functionality, based on the comparison in step d).

2. A method according to claim 1, further comprising:

in step b) the reduction of the first fuel pressure ($P_{in}$) in the position in the low pressure part is carried out toward a predetermined minimum pressure ($P_{min}$), at which the high pressure pump functioning normally is incapable of delivering a second fuel pressure ($P_s$) in the accumulator tank which reaches the requested reference value ($P_B$); and when the fuel pressure in the position in the low pressure part at which the second fuel pressure ($P_S$) in the accumulator tank falls below the reference value ($P_B$), registering the fallen pressure in the accumulator tank as a limit pressure ($P_G$).

3. A method according to claim 2, further comprising:

carrying out the pressure reduction in step b) down to a pressure higher than or equal to the minimum pressure ($P_{min}$), and the fuel pressure in the low pressure part at which the comparison in step d) provides a measurable difference, registering the fuel pressure in the low pressure part as the limit pressure and using the limit pressure to determine the pump's functionality.

4. A method according to claim 2, further comprising interrupting the pressure reduction in step b) when the second fuel pressure ($P_s$) in the accumulator tank falls below the requested reference value ($P_B$) by a predetermined difference value ($\Delta$).

5. A method according to claim 4, further comprising interrupting the pressure reduction in step b) when the difference value ($\Delta$) is 25-100 bar.

6. A method according to claim 1, further comprising:

controlling the feeding pump in step b) so that the first fuel pressure ($P_{in}$) in the position reduces to below a minimum pressure ($P_{min}$) by at least 5%, when the high pressure pump in its normal functioning is incapable of delivering a second fuel pressure ($P_s$) in the accumulator tank wherein the second pressure is according to the requested reference value ($P_B$).

7. A method according to claim 1, further comprising carrying out the method in a high pressure pump with several of the pump elements connected in parallel and between the low pressure part of the system and the accumulator tank, wherein at a stationary operating mode of the combustion engine at which one of the pump elements is capable of alone delivering a second fuel pressure ($P_S$) in the accumulator tank (6) according to the requested reference value ($P_B$), and wherein steps a)-d) are carried out during the control of the high pressure pump's pumping elements, so that a single one of the pump elements alone delivers the second fuel pressure ($P_S$) which is requested in the accumulator tank in order to determine the functionality of the single one of the pump elements.

8. A method according to claim 7, further comprising carrying out the steps a)-d) with time intervals for all of the pump elements, during the control of the high pressure pump's pump elements, so that a single one of the pump elements delivers a second fuel pressure ($P_S$) in the accumulator tank according to the requested reference value ($P_B$), for the determination of the functionality of all the pump elements.

9. A method according to claim 1, further comprising storing data prepared during the performance of the method steps, to provide for a possibility of a later assessment of the functionality of the high pressure pump or the high pressure pump and its pump elements.

10. In a system for fuel injection in a combustion engine, a device for controlling functionality, wherein the system comprises:

a feeding pump, controllable independently of the combustion engine, and configured for supplying fuel in a low pressure part of the system to the high pressure pump, an accumulator tank for fuel injection to the combustion engine, the high pressure pump comprises at least one pump element which is connected between the low pressure part and the accumulator tank, the pump element has one cylinder including a pump chamber with a moveable piston therein for pumping;

the cylinder having a connecting opening to the low pressure part;

an inlet valve arranged in the cylinder's connecting opening, the inlet valve being controllable to control a flow of fuel into the pump chamber;

first measuring elements configured to measure a first fuel pressure ($P_{in}$) in a position in the low pressure part and at the inlet to the high pressure pump, second measuring elements configured to measure a second fuel pressure ($P_S$) in the accumulator tank;

a control device configured to control the feeding pump during stationary operating modes of the combustion engine with a constant requested reference value ($P_B$) for the fuel pressure in the accumulator tank, the control device is configured to control the feeding pump to reduce the first fuel pressure $P_{in}$ in the position in the low pressure part, the first and second measuring elements being configured to measure the first fuel pressure ($P_{in}$) in the low pressure part and the second fuel pressure ($P_S$) in the accumulator tank during pressure reduction in the low pressure part; and a device configured to compare development of the accumulator tank second pressure ($P_S$) with a reference value ($P_B$) during the pressure reduction in the low pressure part, via control of the feeding pump and based on the comparison, the device generates information about the high pressure pump's functionality.

11. A device according to claim 10, further comprising the control device is configured to carry out the pressure reduction in the position in the low pressure part down toward a predetermined minimum pressure ($P_{min}$), at which the high pressure pump in normal functioning is unable to deliver a second fuel-pressure ($P_s$) in the accumulator tank with the requested reference value ($P_B$), and in the event of a fall in the second fuel pressure ($P_S$) in the accumulator tank below the requested reference value, the device being configured to register the fuel pressure ($P_G$) in the position in the low pressure part at which this occurs.

12. A device according to claim 10, further comprising the control device is configured to control the feeding pump to reduce the first fuel pressure ($P_{in}$) in the position in the low pressure part to a level which falls below a minimum pressure ($P_{min}$) by at least 5%, at which the high pressure pump in a normal position is not able to achieve a second fuel pressure ($P_S$) in the accumulator tank, wherein the second fuel pressure is according to the requested reference value ($P_B$).

13. A computer program product comprising a non-volatile data storage medium which is readable by a computer, and a computer program stored on the medium; the computer program comprising computer program code, which when run on a computer, causes the computer to control the steps according to claim 1.

14. A motor vehicle, comprises a device according to claim 10.

* * * * *